United States Patent [19]

Nordstrom et al.

[11] 4,294,185

[45] Oct. 13, 1981

[54] SYSTEM FOR SECURING CONTAINERS IN A SHIP'S HOLD

[76] Inventors: Immo R. Nordstrom, P.O. Box 305, Fair Haven, N.J. 07701; Johannes A. Bak, Prunuslaan 41, Dordrecht, Netherlands

[21] Appl. No.: 940,767

[22] Filed: Sep. 8, 1978

Related U.S. Application Data

[63] Continuation-in-part of Ser. No. 830,500, Sep. 6, 1977, abandoned.

[51] Int. Cl.[3] ..... B63B 25/08

[52] U.S. Cl. ..... 114/75; 220/23.4; 410/77; 410/95; 24/287

[58] Field of Search ..... 114/72, 75; 410/71-86, 410/94, 95; 244/118 R; 220/23.4; 206/504, 586, 453

[56] References Cited

U.S. PATENT DOCUMENTS

| | | | |
|---|---|---|---|
| 2,202,837 | 6/1940 | Cox | 296/19 |
| 2,733,672 | 2/1956 | Pierce | 244/118 R |
| 3,092,282 | 6/1963 | Tantlinger | 220/23.4 |
| 3,365,229 | 1/1968 | Hitch | 220/23.4 |
| 3,583,350 | 6/1971 | Goldman | 114/72 |
| 3,601,866 | 8/1971 | Odin | 410/78 |
| 3,602,474 | 8/1971 | Deering | 410/84 |
| 3,691,595 | 9/1972 | Backteman | 105/366 D |
| 3,701,079 | 10/1972 | Bowden | 220/23.4 |
| 3,836,043 | 9/1974 | Levin | 206/586 |
| 3,972,425 | 6/1974 | DiMartino | 410/77 |
| 3,984,117 | 10/1976 | Bates | 410/77 |
| 4,213,532 | 7/1980 | Eggert | 206/504 |

*Primary Examiner*—Trygve M. Blix
*Assistant Examiner*—D. W. Keen
*Attorney, Agent, or Firm*—Roylance, Abrams, Berdo & Farley

[57] ABSTRACT

A system for securing two containers in a cell in a ship's hold wherein, at the midpoint of the length of the cell and at at least one side of the cell a flanged guide device is attached to the ship's structure, which guide device cooperates with two guiding hooks which are each detachably connected to a bottom corner piece of one of the containers at the sides thereof, the guiding hooks being mounted so that the hook on one container is turned toward the hook on the other container to engage the guide device flanges. In a further embodiment wherein containers are placed in a cargo cell side-by-side, hook assemblies are detachably connected to corner pieces of adjacent sides of the containers so that they are locked to each other to prevent movement of the containers during pitch and roll of the ship.

20 Claims, 11 Drawing Figures

SYSTEM FOR SECURING CONTAINERS IN A SHIP'S HOLD

This application is a continuation-in-part of U.S. patent application Ser. No. 830,500, filed Sept. 6, 1977, now abandoned.

This invention relates to a system for securing containers in a cell in a ship's hold.

BACKGROUND OF THE INVENTION

Many container ships are equipped with separate cells to receive 40-foot containers and other cells to receive 20-foot containers. There is a tendency, however, to equip ships with 40-foot or longer cells only, in which, when necessary, 20-foot containers are then stowed end-to-end in pairs or larger numbers. In either case, containers are usually stacked on top of each other, these cells being sufficiently deep to hold a stack two or more containers high.

As is well-known, the so-called 20-foot standard container is actually 19'-10½" long, while the 40-foot container measures 40 feet in length. Thus, when two 20-foot containers are placed in a 40-foot cell, there is a gap amounting to about 3" between the adjacent ends of the containers.

When two 20-foot containers are placed in a 40-foot cell, the outer ends of the containers (the ends facing away from each other) commonly fit between vertically extending pillars or beams which have an L-shaped cross section mating with the container corners, these corner beams being firmly connected to the structure of the vessel. However, the adjacent ends of the pair or pairs of containers are not supported in the lateral direction by any guiding surface connected to the ship. Thus, the pile of containers is relatively free to move in the cross direction as a result of the motion of the ship as it rides swells in the ocean.

To prevent this, the lowermost containers of the pile are placed on removable pins which engage holes in the corner pieces on the containers, or else the lowermost containers are placed between fixed cams and the mutual movement of the other containers in the same pile is prevented by providing loose double-sided piling pins or dowels between each upper container in the pile and the container beneath it. To maintain the horizontal position of the containers, these dowels must be placed at all four corners.

The job of placing the dowels and removing them during loading and unloading, respectively, of the containers requires the continuous or repeated presence of personnel in the hold and requires the handling of four relatively heavy objects for each container being loaded or unloaded. This work involves much climbing and is not without danger because it occurs from time-to-time that a dowel becomes stuck in the underside of the container and is hoisted with the container, only to fall out again at an inconvenient moment.

The foregoing discussion has primarily considered the situation which involves a cargo cell designed wide enough to receive only one cargo container. However, a further problem arises in cargo cells which are designed to receive two or more containers in side-by-side relationship, i.e., wherein the cargo cell is wider than the width needed to receive only one container. Normally, such containers are 8 feet in width and the cells are therefore dimensioned to receive either one container (or two or more end-to-end) with a few inches of lateral clearance, e.g., 8'2" wide, or else are designed to receive an array of containers side-by-side as well as end-to-end, in which case the cells are dimensioned to be a multiple of the container width plus some clearance.

It has been normal practice in the past to install pillars, special lashings or other attachments in the hold of a ship to receive these arrays of containers and to prevent lateral movement of the containers in the cell when the ship rolls or pitches, and to permit vertical stacking of arrays in a cell which has sufficient vertical depth to receive two or more stacked container arrays. Examples of such arrangements are shown in U.S. Pat. No. 3,583,350, Goldman, and British Pat. No. 1,188,316, Mitsubishi. The use of vertical pillars or beams, wire lashings, locking screws, dowel plates and other known arrangements all have serious disadvantages. In the case of pillars and support trusses, the structures must be relocated if the permutation of container lengths is changed. Others of the devices mentioned require that they be installed (or removed) at various stages during a loading (or unloading) operation, which is not only time consuming but also requires workers going into and out of the cargo cell repeatedly. Some of these structures also are not completely secure and can involve loss of cargo space, requiring that the cargo cell be initially designed longer or wider or both.

BRIEF DESCRIPTION OF THE INVENTION

An object of the present invention is to provide an apparatus for securing containers in the hold of a ship, which apparatus avoids the need for individuals working in the hold and especially to provide a system for securing two containers end-to-end in a cargo cell in a ship's hold with the use of which the containers can be placed in the hold quickly and easily and which results in excellent securing of the containers.

Briefly described, in one aspect, the invention includes an apparatus for securing containers in a storage or cargo cell in a ship's hold wherein the containers are of substantially equal length and the storage cell is greater in length than the combined lengths of two such containers, the storage cell having a bottom wall and vertical side and end walls, and wherein each of the containers is of a type having corner pieces as a structural part of the container, each said corner piece having an elongated side opening therein, the apparatus comprising guide means structurally attached to a vertical side wall of the storage cell for guiding the containers, the guide means having elongated flange portions extending vertically upwardly from a location adjacent the bottom wall thereof; first and second guide hooks; and means for detachably mounting each of the guide hooks in an opening in a corner piece of each of the containers on the same side as, and at the end closest to, the other container, each of said guide hooks having a recess portion directed toward the other guide hook, whereby said hooks lie on opposite sides of, and partially enclose, said flange portions of said guide means.

In another aspect, the invention includes an apparatus for interconnecting containers in a storage cell of a ship's hold to restrain the containers against relative movement, the containers being of the type having a generally parallelepiped shape and having corner pieces as a structural part of the container, each corner piece having an elongated side opening therein, the apparatus comprising a plurality of pairs of substantially identical mating, interengageable hook members, each of said hook members comprising a generally C-shaped body having an inner leg, an outer leg and an interconnecting portion between said legs, the inner and outer legs being spaced apart by a distance substantially equal to the thickness of said outer leg, and means on the inner leg of each of said hook members for releasably attaching an associated hook member to a corner piece through the side opening therein, whereby pairs of said hook members can be attached to adjacent corners of adjacent containers with the open ends thereof facing in oposite directions to permit latching together of said adjacent containers.

The foregoing devices can be used in conjunction with each other in such a way that the containers are restrained against movement relative to the structure of the cargo cell and relative to each other without the need for any fillers or other restraining devices.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
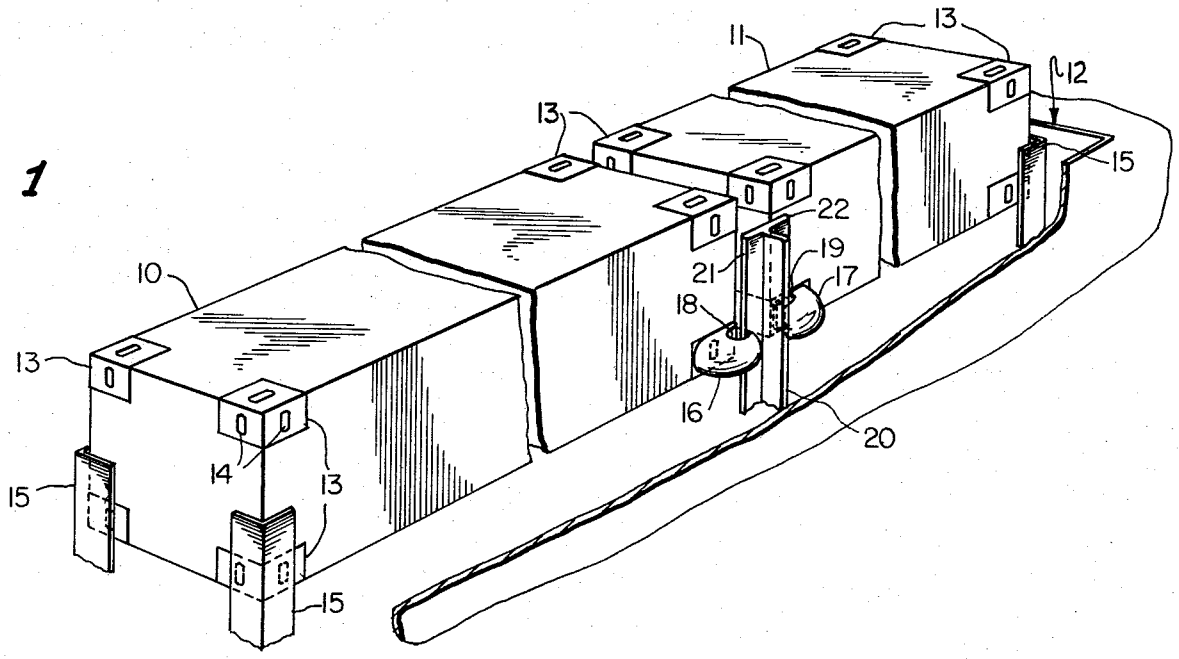
FIG. 1 is a partial schematic perspective view of two cargo containers being received in a partially shown cargo cell and guided by apparatus in accordance with the invention.

FIG. 1 shows cargo containers 10 and 11 in a "suspended" position as they might exist while they are being lowered into a cargo cell 12 which is only partially shown. The cargo containers are rectangular parallelepipeds having corner pieces 13 which are conventional in nature and which are provided as an integral structural part of the cargo containers. The corner pieces 13 are provided with elongated openings 14, generally oval in shape, which are designed to receive pins, pegs or other fittings to lift and handle the containers. Each corner piece has three such openings, one on each major surface of the container.

The cargo cell itself is, of course, an integral portion of the ship and is normally a generally rectangular cavity, open or openable at the top, into which cargo containers such as those shown, or cargo in other forms, can be inserted. Normally, such cargo cells are provided with corner guide members 15 which are vertical L-shaped structural steel members firmely attached to the ship structure to guide and provide lateral and longitudinal restraint and support for articles such as the cargo containers.

It will be recognized from FIG. 1 that some form of crane and spreader apparatus would normally be employed to lower the cargo containers into the cargo cell, but the spreader or spreaders and crane mechanisms have been omitted from these figures for simplicity.

In accordance with the invention, cargo container 10 is provided with a guiding hook 16 which is detachably mounted to the one of corner pieces 13 which is at the bottom of container 10 at the end closest to container 11. Similarly, container 11 is provided with a guiding hook 17 similarly mounted in the corner piece of the bottom thereof and closest to container 10. Hooks 16 and 17 have generally C- or U-shaped openings 18 and 19, respectively, and the hooks are mounted so that openings 18 and 19 face toward each other.

In accordance with the invention, the cargo cell in the ship is provided with a flanged guide device in the form of an elongated beam 20 having a T-shaped cross section, the head of the T forming flanges 21 and 22 which extend generally parallel to the side wall of the cargo container. The leg of the T perpendicular to the flange portions is contiguous with the cell wall and can be firmly attached thereto, as by welding.

As previously mentioned, containers referred to in this field as 20-foot containers are actually 19'-10½" in length so that two such containers placed end-to-end, with the outer ends adjacent corner guide members 15, rest in the cell with a gap between their closest points of approximately three inches in the case of a 40-foot cell which is receiving two 20-foot cargo containers having a cumulative length of 39'9".

It is particularly significant that hook members 16 and 17 can be mounted on containers 10 and 11 while the containers are still on the dock or quay before they are loaded into the cargo cell of the vessel, and that they need not be removed until the cargo containers have been unloaded from the cargo cell in the reverse process. Alternatively, the hook members can be attached to the cargo containers as they rest on the deck of a vessel in the case where they are placed on the deck before being lowered into the cargo cell, or as an intermediate step in the unloading process. Thus, there is no need for workmen to descend into the cargo cell for attachment or detachment of the hook members. Furthermore, it will be seen that only a single guide hook for each 20-foot container is needed rather than the four dowels previously required, and the danger of the devices inadvertently becoming detached from a cargo container during loading or unloading is eliminated.

During the loading process, the hooks are connected to the containers and the containers are then lowered into the cell, guided so that they enter the space defined by corner members 15 and the flanges of beam 20. It will be recognized that the containers can be loaded or unloaded individually, or that they can be handled together by a spreader apparatus adapted to that purpose. Furthermore, when using the apparatus of the present invention, it is not necessary that the containers of a pair be placed very accurately with respect to each other before the guiding hook is attached, having the advantage of time saving. The combination of the hook member and the corner posts permits guiding the container into the cargo cell and, once in place on the bottom of the cell, the cargo container is restrained against significant lateral or longitudinal movement, the strength of the hook devices and the guide beam being sufficient to resist forces perpendicular to the longitudinal axis of the ship or parallel with the longitudinal axis thereof. Since the hook devices partially enclose the flanges, the forces involved are transmitted in both directions, both to port and starboard.

Figure 2:
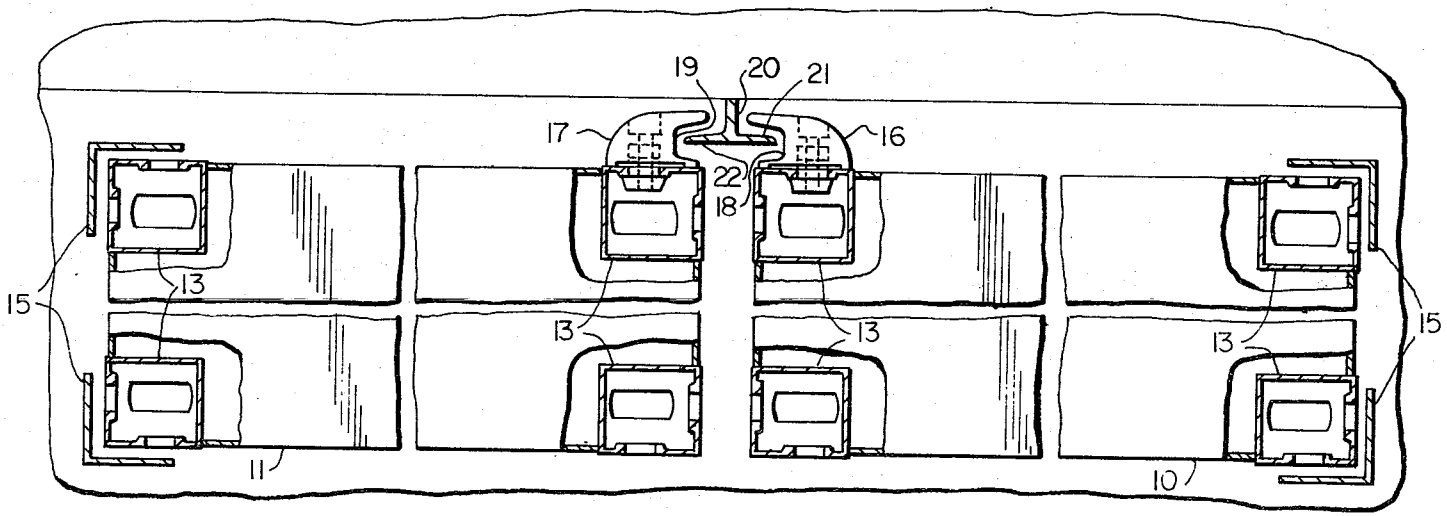
FIG. 2 is a partial plan view, in partial section, of containers in a cell incorporating apparatus in accordance with the invention.
Figure 3:
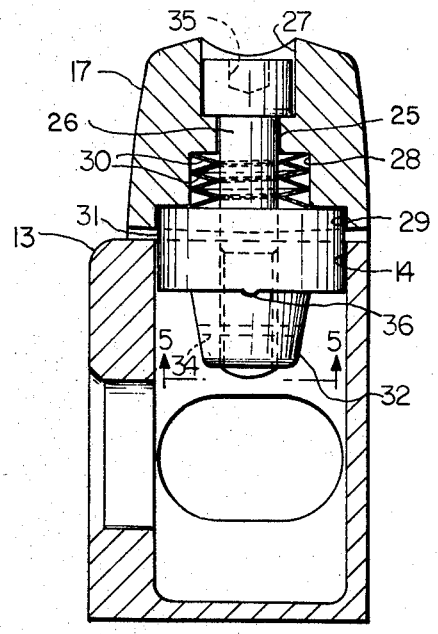
FIG. 3 is a side elevation, in partial section, of a guide hook and mounting means in accordance with the invention.
Figure 5:
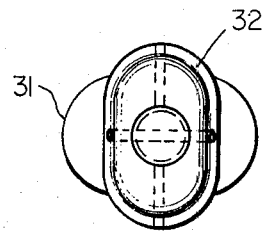
FIG. 5 is a bottom view, in partial section, of the apparatus of FIG. 3.

Once in place, containers 10 and 11 rest in the bottom of a cargo hold in a manner shown in FIG. 2. As shown therein, there is some lateral clearance between flanges 21 and 22 and the interior surfaces of openings 18 and 19 in hooks 16 and 17. Also, in the situation illustrated in FIG. 2, the cell is designed to receive one 40-foot container or two 20-foot containers end-to-end, and the corner members 15 are therefore provided on both sides of the ends of the containers. It will be observed from FIG. 2 that a 40-foot container can be placed in this cell without the need for any modification whatsoever to the structural portions of the ship. The hooks, of course, would not be used in that circumstance.

The details of a hook structure suitable for use in the apparatus of FIGS. 1 and 2 is shown in FIGS. 3–6. Since the hook members are substantially identical to each other, only one such member is shown in detail, hook 17 being selected for purposes of illustration, along with the means for detachably mounting the hook in the corner member 13.

As shown in FIGS. 3–6, hook 17 is provided with a bore 25 extending therethrough to receive a bolt 26. Bore 25 has an enlarged outer portion 27 to receive the enlarged cylindrical head of bolt 26 and two inner recesses 28 and 29 which are also larger than the smaller portion of bore 25 and the shank of bolt 26. Portion 28 is adapted to receive a plurality of frustoconical spring washers 30, commonly referred to as Belleville washers, which perform the function of a compression spring. Recess 29 is an elongated recess, generally oval in shape, and is substantially the same size and shape as the openings 14 through the corner pieces. This recess is intended to receive one end of a plug member 31 having a central opening through which bolt 26 extends. The axial length of plug 31 is selected so that the portion which protrudes beyond the hook member itself passes through the wall thickness of the corner member at the location of opening 14.

Figure 6:
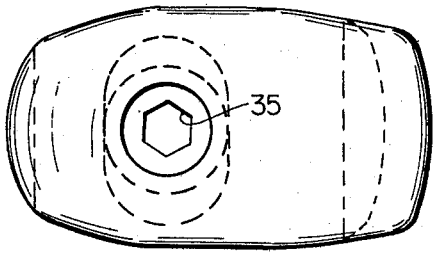
FIG. 6 is a front elevation of the apparatus of FIGS. 3 and 4.

Inside the corner member, when the hook member is attached, is a swivel member 32 which has a central opening 33 which is internally threaded to receive the externally threaded end of bolt 26. A pin or set screw 34 passes through the swivel member and the bolt, after the two are properly assembled, to prevent relative rotation thereof. The head portion of bolt 26 is provided with a recess 35 which is hexogonal in shape, as shown in FIG. 6, to receive a tool, in the nature of a large Allen wrench, such that the bolt can be rotated from outside the hook member. Because of pin 34, when bolt 26 is rotated, swivel member 32 also rotates.

The surface of plug 31 which faces swivel member 32 is provided with a protruding ridge or rib 36 and swivel member 32 is provided with a mating groove 37 to receive the rib. As will be apparent, washers 30 tend to urge the plug into firm engagement with the swivel members so that the abutting surfaces thereof are in substantially full continuous contact.

Figure 4:
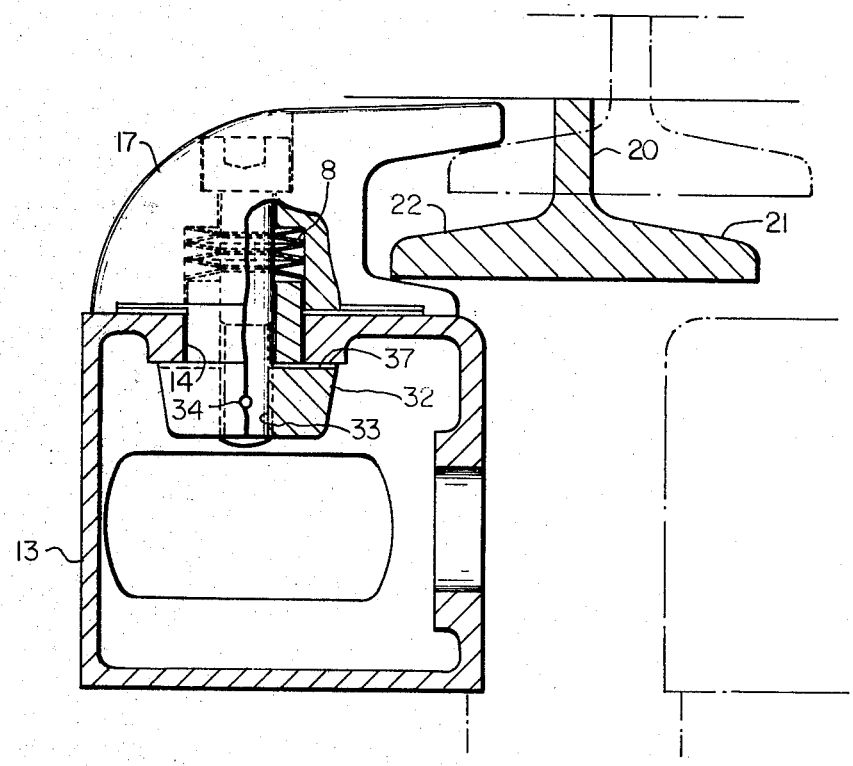
FIG. 4 is a top plan view, in partial section, of the apparatus of FIG. 3.

When assembling the hook to the corner member, bolt 26 is rotated to cause swivel member 32 to occupy a position 90° from that shown in the figure so that its longitudinal axis (its longest dimension perpendicular to the axis of bolt 26) is aligned with the similar axis of plug 31. The swivel member and plug are then inserted through the appropriate opening 14, and bolt 26 is again rotated to rotate swivel member 32 to the position shown. When so rotated, as shown in FIG. 4, the surface of swivel member 32 which faces the hook comes into abutting contact with the interior surfaces of the corner member adjacent opening 14, preventing the hook member from being removed. In that position, the swivel member is locked by the coaction of ridge 36 and groove 37 to avoid the possibility of the hook inadvertently coming loose from the corner member.

Figure 7:
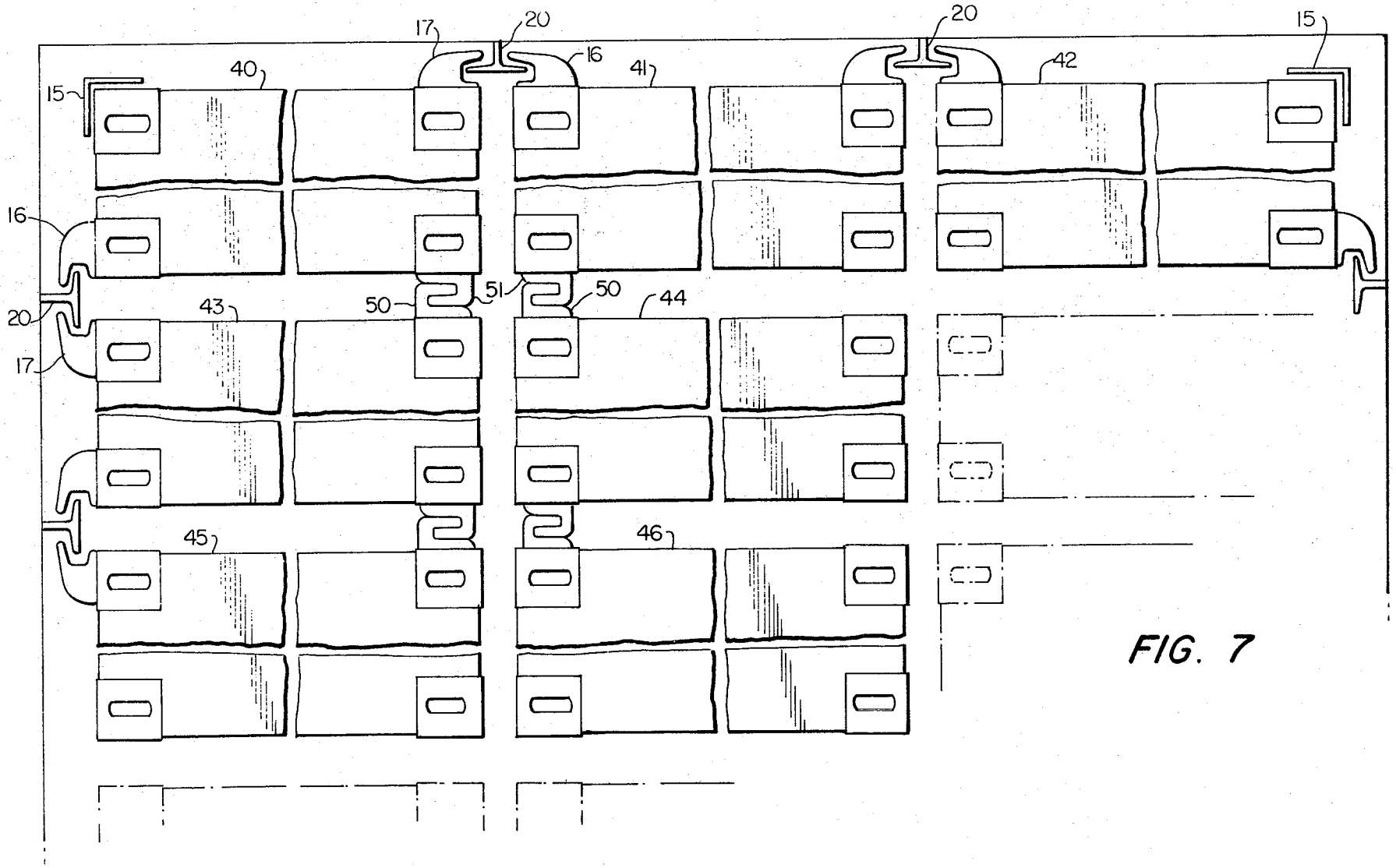
FIG. 7 is a partial top plan view of a further embodiment of an apparatus in accordance with the invention.

As previously indicated, it is commonly the case that, in addition to placing containers in an end-to-end relationship in a cargo cell, a cell will be designed somewhat wider to receive rows of such containers side-by-side. In order to avoid the need for installing intervening pillars or other restraining devices, a further structure in accordance with the invention can be employed as illustrated in FIG. 7. As shown in FIG. 7, one layer of containers 40–46 are shown, it being understood that, as with the embodiment shown and discussed in connection with FIGS. 1 and 2, plural layers of such containers can be placed one on top of the other. As before, there are provided in the cell at the corners thereof guiding angles 15. Along the side and end walls of the cell, a plurality of guide beams 20 are provided having vertically extending flanges which cooperate with pairs of hook members 16 and 17 as previously described. While these hook members are adequate to restrain the peripheral containers 40–43 and 45, and the equivalent containers at the other end of the cargo cell, there are containers such as 44 which have no other restraint and containers such as 43 which have no restraint at the end facing away from the bulkhead of the cargo cell. For puposes of firmly interconnecting and restraining these cargo cells against movement, there is provided a further set of hook structures including pairs of hook members 50 and 51 between the ends of adjacent containers. These hook members are detachably connected to corner pieces of their associated containers in a manner substantially identical to that described in connection with hook members 16 and 17, but the hook members themselves are formed somewhat differently. These hook members are shown in detail in FIGS. 8–10. The hook members are substantially identical to each other, the only difference being the mounting thereof to the corner pieces as with members 16 and 17, the mounting being such that the open portions thereof face each other so that the members can interengage. Thus, only a hook member 50 will be described in detail.

Figure 8:
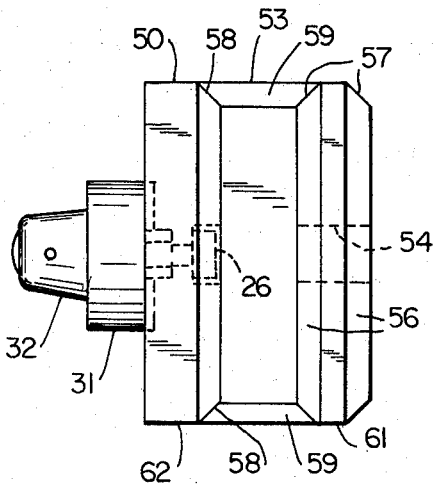
FIGS. 8, 9 and 10 are side and front elevations and a top plan view, respectively, of a hook member usable in the embodiment of FIG. 7.
Figure 9:
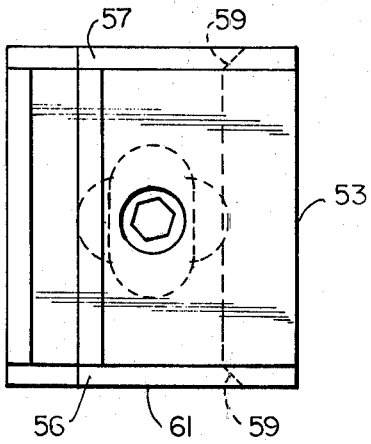
Figure 10:
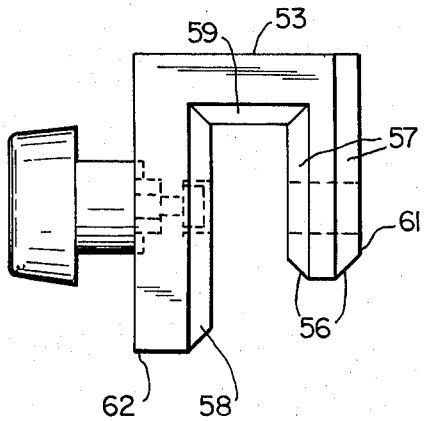

As seen in FIGS. 8–10, each hook member 50 or 51 includes an outer leg 61, an inner leg 62 and an interconnnecting portion 53 which extends between the ends of legs 61 and 62. These bodies form a generally U or C shaped structure wherein legs 61 and 62 are spaced apart a distance substantially equal to the thickness of leg 61. The length of leg 61 is smaller than the length of leg 62 by an amount slightly larger than the thickness of leg 53. This permits the legs to be interengaged as illustrated in FIG. 7, with very little clearance. The inner leg 62 is provided with a bore therethrough to receive a bolt 26 having an hexagonal opening therein, as described in FIGS. 3–6, to receive a tool, and outer leg 61 is provided with an opening 54 which is somewhat larger than the tool to permit access to the head of bolt 26. Bolt 26 passes through a plug 31 and engages a swivel member 32, the operation and function of which are substantially identical to that shown in FIGS. 3–6. These components will therefore not be further described.

As will be seen, the distal edges of certain portions of the legs are chamfered to form cam surfaces so that, in the event of slight misalignment during loading of the containers, the surfaces will tend to align each other and cause the outer legs to enter the spaces in the mating hook members. Thus, the distal edge of outer leg 61 is provided with chamfered surfaces 56 and the upper and lower edges of the outer leg can be chamfered, both inside and outside, forming surfaces 57. Similarly, the inner edges of inner leg 62 are chamfered, at the top and bottom thereof at 58, and the upper and lower inner corners of member 53 are chamfered at 59.

Again, it will be recognized that hook member 50 and 51 can readily be detachably connected to the appropriate corner pieces of the containers while they still rest on the dock or the ship surface before loading, or can be removed on the dock or ship deck after unloading, without the need for workers to enter the cargo cell itself for this purpose. The devices are securely attached and have an extremely low probability of becoming detached except intentionally, thereby providing a somewhat safer set of circumstances for individuals in the vicinity of the loading and unlaoding operations. Furthermore, the devices greatly facilitate the loading and unloading operations and render the containers more securely fastened once they are placed within the hold of a ship.

Furthermore, the provision of the interconnecting hook members 50 and 51 can be used with a variety of container permutation. Thus, in the example of FIG. 7, containers 40 and 41 can be replaced, for example, by a single 40 foot container, while container 42 can be a 20 foot container. Then containers 43, 44, 45 and 46 would be replaced by two side-by-side 40 foot containers. The only need which arises is to select the order in which the containers are to be loaded into the cargo cell. Neither beams 20 nor any other portion of the apparatus interferes with, or need be modified to accommodate, different permutations of the containers during the loading operation. The system is therefore significantly more efficient, less expensive and more secure than those represented by the prior art. There is, of course, no limitation, except those imposed by ship size, on the numbers of containers which can be stored end-to-end or side-by-side.

Figure 11:
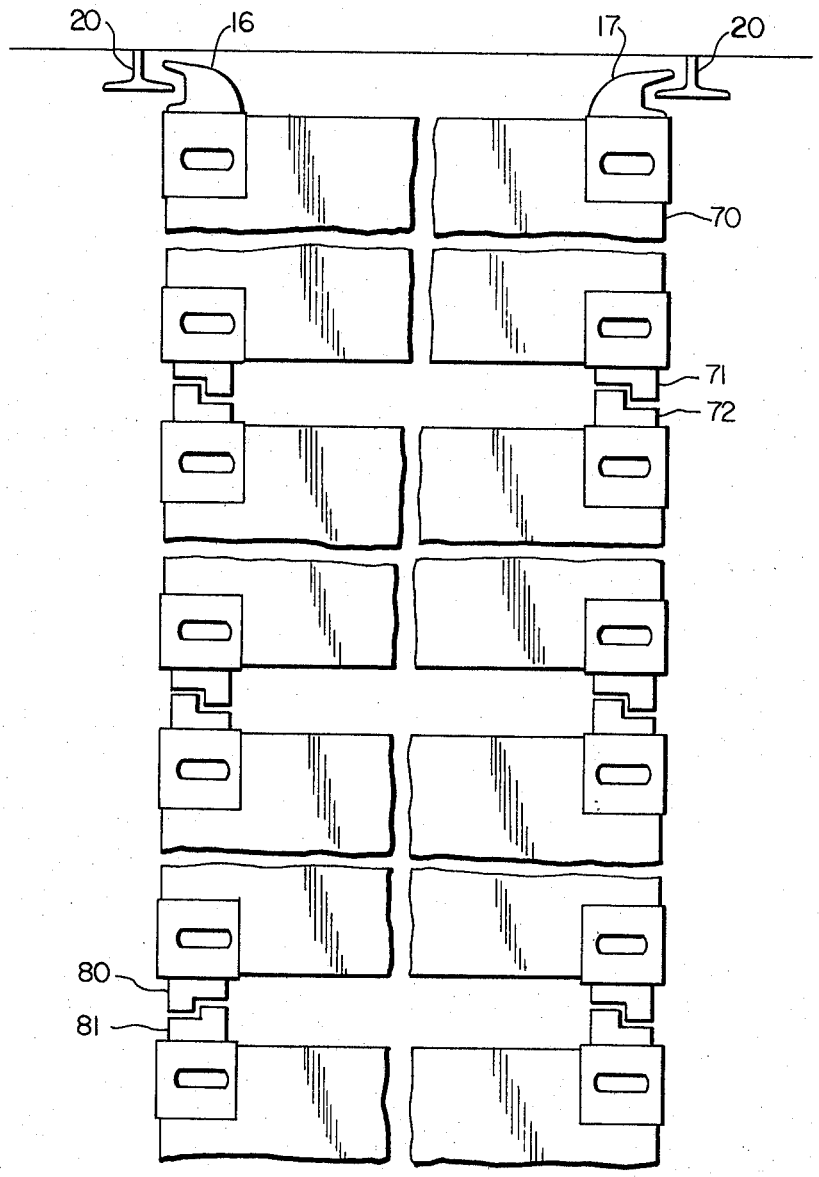
FIG. 11 is a partial top plan view of a further embodiment of an apparatus in accordance with the invention.

A further embodiment of a structure usable to confine cargo containers is shown in FIG. 11, this embodiment being usable under certain conditions. As shown therein, several cargo containers 70 are disposed side-by-side in a cargo cell as previously described. The cargo cell is provided with corner members, not shown in FIG. 11, and with beams 20. The cargo containers closest to the cell wall are provided with hook members 16 and 17 as previously described, but hook members 50 and 51 are replaced by interengaging buffer members 71 and 72.

Each buffer member has a generally L-shaped outwardly facing surface which mates with and partially engages the oppositely directed and similarly shaped face of the buffer member on the adjacent cargo container, including a recessed portion, a protruding portion and an interconnecting surface or shoulder portion which is generally perpendicular to the side of its associated cargo container.

As will be recognized, buffer members 71 and 72 can be used when the cargo cell is filled, or is to be filled with containers but cannot be used if a cell is to be only partially filled, in contrast to the structure shown in FIG. 7, because the buffer members do not fully interengage and therefore could permit relative movement between containers.

It is, however, possible to fill the cell with empty containers if members 71 and 72 are being used.

Members 71 and 72 have the advantage of being somewhat simpler and less expensive to manufacture and simpler to use than hook members 50 and 51.

As will be recognized, each of members 71 and 72 is provided with rotatable means for attaching the members to the corner piece of a cargo container. Since these members can be attached in positions 180° apart, pairs thereof can be arranged as shown in FIG. 11 or, alternatively, a pair of each set can be rotated 180° if desired for a particular installation. This is illustrated at 80 and 81 in FIG. 11.

While certain advantageous embodiments have been chosen to illustrate the invention it will be understood by those skilled in the art that various changes and modifications can be made therein without departing from the scope of the invention as defined in the appended claims.

What is claimed is:

1. An apparatus for securing containers in a storage or cargo cell in a ship's hold wherein the containers are of substantially equal length and the storage cell is greater in length than the combined lengths of two such containers, the storage cell having a bottom wall and vertical side and end walls, and wherein each of the containers is of a type having corner pieces as a structural part of the container, each said corner piece having an elongated side opening therein, the apparatus comprising guide means structurally attached to a vertical side wall of the storage cell for guiding the containers said guide means having elongated flange portions extending vertically upwardly from a location adjacent the bottom wall thereof;

first and second guide hooks;

and means for detachably mounting each of said guide hooks in an opening in a corner piece of each of the containers on the same side as, and at the end closest to, the other container, each of said guide hooks having a recess portion directed toward the other guide hook, whereby said hooks lie on opposite sides of, and partially enclose, said flange portions of said guide means.

2. An apparatus according to claim 1 wherein said guide means comprises an elongated member having a T shape in cross section, the top portion of the T forming said flange portions.

3. An apparatus according to claim 2 wherein each of said means for mountng said guide hooks includes a swivel member having a shape corresponding to the shape of the elongated openings in said corner members; and a bolt passing through said guide hook and into said swivel member, said bolt having an enlarged cylindrical head and said bolt and swivel member being rotatable together;

and wherein said guide hook is provided with a recess in its outer surface to receive said enlarged head.

4. an apparatus according to claim 3 wherein said enlarged head is provided with means defining a recess for receiving a tool to rotate said bolt and swivel member so that, after insertion of said swivel member through said opening, rotation thereof through substantially 90° prevents removal of said hook.

5. An apparatus according to claim 4 wherein said means for mounting further includes a plug member having a shape corresponding to said elongated opening and a central bore to permit passage of said bolt therethrough, said plug member being disposed between said guide hook and said swivel member.

6. An apparatus according to claim 5 wherein said guide hook includes a surface for abutting the corner piece and a recess in said surface for receiving an end of said plug so that said plug is prevented from rotating relative to said guide hook.

7. An apparatus according to claim 6 wherein said means for mounting includes a plurality of compression spring members surrounding said bolt in said guide hook, said spring members acting between said plug and said hook to urge said plug into continuous engagement with said swivel member.

8. An apparatus according to claim 7 wherein said plug and swivel member have abutting surfaces, said plug having at least one ridge protruding from its abutting surface and said swivel member is provided with at least one groove to mate with and receive said ridge to retain said members in a selected one of positions separated by substantially 90° of rotation.

9. An apparatus according to claim 1 for use in a storage cell having a width greater than the combined widths of a plurality of containers and for interconnecting containers placed in said cell to restrain them against relative movement, the containers being of the type having a generally parallelepiped shape and having corner pieces as a structural part of the container, each corner piece having an elongated side opening therein, the apparatus comprising a plurality of pairs of substantially identical mating, interengageable hook members, each of said hook members comprising a generally C-shaped body having an inner leg, an outer leg and an interconnecting portion, said inner and outer legs being spaced apart by a distance substantially equal to the thickness of said outer leg, and means on the inner leg of each of said hook members for releasably attaching an associated hook member to a corner piece through the side opening therein, whereby pairs of said hook members can be attached to adjacent corners of adjacent containers with the open ends thereof facing in opposite directions to permit latching together of said adjacent containers.

10. An apparatus for interconnecting containers in a storage cell of a ship's hold to restrain the containers against relative movement, the containers being of the type having a generally parallelepiped shape and having corner pieces as a structural part of the container, each corner piece having an elongated side opening therein, the apparatus comprising a plurality of pairs of substantially identical mating, interengageable hook members, each of said hook members comprising a generally C-shaped body having an inner leg, an outer leg and an interconnecting portion, said inner and outer legs being spaced apart by a distance substantially equal to the thickness of said outer leg, and means on the inner leg of each of said hook members for releasably mounting an associated hook member to a corner piece through the side opening therein with said inner leg lying adjacent to and extending in a first plane which is substantially parallel with the outer surface of the corner piece and with said outer leg lying in a second plane which is generally parallel to and spaced outwardly of said first plane containing said inner leg, whereby pairs of said hook members can be attached to adjacent corners of adjacent containers with the open ends thereof facing in opposite directions to permit latching together of said adjacent containers.

11. An apparatus according to claim 10 wherein each of said inner and outer legs and said interconnecting portion comprises a generally rectangular body having top and bottom surfaces and inner and outer walls, and wherein the junctions between the top surfaces of said bodies and the inner walls thereof and between the top surface and the outer wall of said outer leg are chamfered.

12. An apparatus according to claim 11 wherein the junctions between said bottom surfaces of said bodies and the inner walls thereof and between the bottom surface and the outer wall of said outer leg are chamfered.

13. An apparatus according to claim 10 wherein each of said means for mounting said hook members includes a swivel member having a shape corresponding to the shape of the elongated openings in said corner members; and a bolt passing through said inner leg of said hook member and into said swivel member, said bolt having an enlarged cylindrical head and said bolt and swivel member being rotatable together;

and wherein said inner leg is provided with a recess in its outer surface to receive said enlarged head.

14. An apparatus according to claim 13 wherein said enlarged head is provided with means defining a recess for receiving a tool to rotate said bolt and swivel member so that, after insertion of said swivel member through said opening, rotation thereof through substantially 90° prevents removal of said hook member.

15. An apparatus according to claim 14 wherein said means for mounting further includes a plug member having a shape corresponding to said elongated opening and a central bore to permit passage of said bolt therethrough, said plug member being disposed between said inner leg of said hook member and said swivel member.

16. An apparatus according to claim 15 wherein said inner leg includes a surface for abutting the corner piece and a recess in said surface for receiving an end of said plug so that said plug is prevented from rotating relative to said hook member.

17. An apparatus according to claim 16 wherein said means for mounting includes a plurality of compression spring members surrounding said bolt in said hook member, said spring members acting between said plug and said hook member to urge said plug into continuous engagement with said swivel member.

18. An apparatus according to claim 17 wherein said plug and swivel member have abutting surfaces, said plug having at least one ridge protruding from its abutting surface and said swivel member is provided with at least one groove to mate with and receive said ridge to retain said members in a selected one of positions separated by substantially 90° of rotation.

19. An apparatus for interconnecting containers in a storage cell of a ship's hold to restrain the containers against relative movement, the containers being of the type having a generally parallelepiped shape and having corner pieces as a structural part of the container, each corner piece having an elongated side opening therein, the apparatus comprising a plurality of pairs of substantially identical mating buffer members, each of said buffer members comprising means defining a generally L-shaped face having a recessed portion, a protruding portion and interconnecting shoulder portion;

means on each of said buffer members for releasably attaching the member to a corner piece through the side opening therein in one of two opposed orientations, whereby pairs of said buffer members can be attached to adjacent corners of adjacent containers with the protruding portions thereof disposed in opposite directions to permit interengagement of said adjacent containers.

20. An apparatus according to claim 1 further comprising a plurality of pairs of substantially identical mating buffer members, each of said buffer members comprising means defining a generally L-shaped face having a recessed portion, a protruding portion and interconnecting shoulder portion;

means on each of said buffer members for releasably attaching the member to a corner piece through the side opening therein in one of two opposed orientations;

whereby pairs of said buffer members can be attached to adjacent corners of adjacent containers with the protruding portions thereof disposed in opposite directions to permit interengagement of said adjacent containers.

* * * * *